United States Patent [19]

Fukae et al.

[11] Patent Number: 4,956,676

[45] Date of Patent: Sep. 11, 1990

[54] ELECTROGRAPHIC COLOR PRINTER/COPIER

[75] Inventors: Kensuke Fukae, Monsey, N.Y.; Koichi Kinoshita, Shizuka, Japan

[73] Assignee: Kentek Information Systems, Inc., Allendale, N.J.

[21] Appl. No.: 49,715

[22] Filed: May 12, 1987

Related U.S. Application Data

[63] Continuation-in-part of Ser. No. 39,523, Apr. 16, 1987, abandoned.

[51] Int. Cl.[5] ..... G03G 15/16; G03G 15/01

[52] U.S. Cl. ..... 355/271; 355/326

[58] Field of Search ..... 355/212, 309, 326, 271, 355/272, 327, 328, 274

[56] References Cited

U.S. PATENT DOCUMENTS

| | | | |
|---|---|---|---|
| 3,661,452 | 5/1972 | Hewes et al. . | |
| 3,838,919 | 10/1974 | Takahashi . | |
| 3,900,003 | 8/1975 | Sato et al. . | |
| 4,088,403 | 5/1978 | Kingsley | 355/212 |
| 4,194,832 | 3/1980 | Tabayashi | 355/212 |
| 4,341,455 | 7/1982 | Fedder . | |
| 4,515,460 | 5/1985 | Knechtel . | |
| 4,541,709 | 9/1985 | Kampschreur . | |
| 4,563,076 | 1/1986 | Takahashi et al. | 355/212 X |
| 4,563,077 | 1/1986 | Komada | 355/212 |
| 4,616,920 | 10/1986 | Itoigawa et al. | 355/212 X |
| 4,652,115 | 3/1987 | Palm et al. . | |
| 4,657,369 | 4/1987 | Takeuchi | 355/212 |
| 4,690,539 | 9/1987 | Radulski et al. . | |

FOREIGN PATENT DOCUMENTS

| | | |
|---|---|---|
| 0171114 | 12/1986 | European Pat. Off. . |
| 3128402 | 4/1982 | Fed. Rep. of Germany . |
| 3214677 | 11/1983 | Fed. Rep. of Germany . |
| 3541230 | 5/1986 | Fed. Rep. of Germany . |
| 1492896 | 11/1977 | United Kingdom . |
| 2040226 | 1/1983 | United Kingdom . |

*Primary Examiner*—R. L. Moses

*Attorney, Agent, or Firm*—Marmorek, Guttman & Rubenstein

[57] ABSTRACT

An electrographic printer/copier capable of producing color prints is disclosed. The color printer/copier comprises a housing, a source of paper and an output for the paper after it is imprinted, a photoconductive member, and a developer unit containing toners of multiple colors. On successive revolutions of the photoconductive member, the developer unit applies a different colored toner to the photoconductive member. After each revolution of the photoconductive belt, the image developed in a particular color is transferred to and retained on a transfer belt. When all of the different colored images have been transferred to the transfer belt, a sheet of paper is brought into contact with the transfer belt and the fully developed color image is transferred to the sheet of paper. In a preferred embodiment, the photoconductive member is a vertically aligned photoconductive belt. The transfer belt is horizontally aligned and located above the photoconductive belt. The sheet of paper travels along a substantially planar paper path located either above or below the transfer belt and the fully developed color image is transferred to the sheet of paper.

32 Claims, 2 Drawing Sheets

ELECTROGRAPHIC COLOR PRINTER/COPIER

BACKGROUND OF THE INVENTION

This is a continuation-in-part of application Ser. No. 039,523, filed Apr. 16, 1987, now abandoned.

This invention relates to an electrographic printer or copying machine capable of producing color prints. More specifically, the present invention relates to an electrographic printer or copying machine wherein a vertically mounted photoconductive belt assembly cooperates with a transfer belt to print in color on a sheet of paper or other recording medium.

In the process of electrographic or xerographic printing, a photoconductive member is employed to record an image. The photoconductive member, which may be in the form of a belt or a drum, is charged to a substantially uniform potential to sensitize its photosensitive surface. In the case of a copying machine, a light is shined on an original document to be copied. Through the use of a slit aperture, mirrors, and various other optical components, the charged portion of the photoconductive surface is exposed to a reflected light image of the original document to be reproduced. The light image is recorded as an electrostatic latent image on the photoconductive member. This latent image corresponds to the informational areas contained on the original document.

In the case of an electrographic printer connected to a computer, a similar process is used to record information on the photoconductive member. The charged portion of the photoconductive surface is exposed to a light image produced by an optical print head. The shape of the light image is controlled by input signals from the computer. For example, a laser or an LED array may be used as an optical print head which receives input signals from the computer to illuminate the photoconductive member with a light image of a particular shape. Here too, an electrostatic latent image corresponding to the desired informational areas is recorded on the photoconductive member.

As used herein, the term "electrographic printing apparatus" and the like refer to both electrographic printers and copiers.

After recording the electrostatic latent image on the photoconductive member, the latent image is developed by bringing a developer material or toner into contact with it. The developer material is attracted to the electrostatic latent image and forms a powder image on the photoconductive member corresponding to the electrostatic latent image. The powder image is subsequently transferred to a sheet of recording medium, such as a sheet of paper, in a transfer region. Thereafter, the powder image is permanently affixed to this sheet in image configuration by a variety of methods, such as by fusing.

The above-mentioned operations may be carried out by arranging a number of stations in sequence about the photoconductive member. Thus, the photoconductive member is usually surrounded in sequence by a charging station to charge the photoconductive member, an imaging station to form an electrostatic latent image on the photoconductive member, a developing station to develop the electrostatic latent image on the photoconductive member, and a transfer station to transfer the developed image from the photoconductive member to the sheet of recording medium. A discharging station and a cleaning station are also arranged about the photoconductive member to ready it for use again.

The assignee of the present application has filed a number of patent applications which disclose and claim an electrographic printing apparatus operating in accordance with the aforementioned principles. The electrographic printer/copier is disclosed in allowed application Ser. No. 700,813, filed Feb. 11, 1985. The electrographic printer/copier described in that application employs a photoconductive belt assembly in the form of a disposable cassette which is described and claimed in allowed application Ser. No. 718,947, filed Apr. 2, 1985, now U.S. 4,657,369. The printer/copier described in application Ser. No. 700,813 also employs the combined developing and cleaning unit which is the subject of allowed application Ser. No. 718,946, filed Apr. 2, 1985, now U.S. 4,639,116. All of the aforementioned patent applications are assigned to the present assignee and all are incorporated herein by reference.

One of the primary objects of the electrogaphic printer/copier described in application Ser. No. 700,813 is to provide a machine which is reliable over an extended period of use and which is easily serviceable. To accomplish this, the operational components of the machine are constructed in the form of modular units which are easily removed and replaced at specified time intervals or when they malfunction.

Another important feature of the printer/copier described in application Ser. No. 700,813 is that it has a simplified paper path. The paper always travels along a substantially planar path located near the top of the machine. This permits the paper path to be easily accessed from the top of the machine when a lid located there is opened. The machine is capable of having this simplified paper path because the photoconductive belt is mounted vertically in the machine. A sheet guiding structure is provided on top of the cassette which guides the sheet of paper across the top of the photoconductive belt. The paper is imprinted on its underside as it passes across the top of the vertically mounted photoconductive belt.

By providing this "straight-through" paper path, the number of paper jams is considerably reduced. In the event a paper jam does occur, the lid of the machine can be opened and the paper jam can be reached easily from the top of the machine. This is in contrast to prior art machines wherein paper jams can only be accessed from the side or front of the machine. Additionally, because the paper is imprinted on its underside, and because the machine has a "straight-through" paper path, the paper is ejected into the output tray face down. Thus, the paper is automatically collated after it is imprinted.

The electrographic printer/copier described in application Ser. No. 700,813 requires two rotations of the photoconductive belt per copy produced. In actual practice, it is capable of producing about 12 copies per minute. During the first rotation of the photoconductive belt, the belt is uniformly charged and a latent image is generated by means of an optical print head on the surface of the photoconductive belt. The latent image thus formed is developed by the deposition of toner from a combined developer/cleaning unit operating in the develop mode. The belt then enters the transfer region wherein the developed image is transferred to the underside of the paper or other copy material. In the transfer region, a transfer unit generates an electrical field which attracts the toner from the photoconductive belt to the underside of the paper. This completes the first rotation of the belt as the paper travels to a fuser unit and is discharged into the output tray.

During the next revolution of the belt, the belt is prepared for making the next copy. The main charging unit and the optical print head are disabled while an erase lamp is activated and the developer/cleaner unit is switched to the clean mode. Thus, as the belt continues to rotate following image transfer, the photoconductive belt is discharged by an erase lamp and the excess toner is removed using a conventional electrostatic process by the developer/cleaner unit. The belt is thereby readied for printing on the next page.

The electrographic printer/copier of the present application is based on principles similar to those of the electrographic printer/copier described in application Ser. No. 700,813. However, it represents a departure from the printer/copier disclosed in that application in that it is capable of printing in color. In order to accomplish this, a developing unit is provided which has a separate receptacle for differently colored toners, e.g., black and three primary colors. A transfer belt is also provided which cooperates with the photoconductive belt to receive the developed image therefrom. The photoconductive belt makes four revolutions during which the colored toner is applied to the belt. On the first revolution, the photoconductive belt picks up one of the toners and transfers it to the transfer belt. On the second revolution, the photoconductive belt picks up a second colored toner and transfers it to the transfer belt. This continues until the photoconductive belt has completed four revolutions and all of the differently colored toners have been applied to the transfer belt. At that point, the paper or other recording medium moves into contact with the transfer belt and the fully colored powder image on the transfer belt is transferred to the sheet of paper.

SUMMARY OF THE INVENTION

In accordance with the present invention, an electrographic color printer/copier is provided which comprises a housing, a source of paper and an output receptacle for receiving the paper after it is printed, a photoconductive member for storing a latent electrostatic image of the information to be imprinted, and a developer unit which contains toners of different colors in separate compartments. The electrographic color printer also includes a transfer belt made from a dielectric insulating material which receives and retains the developed image from the photoconductive belt.

The electrographic printer/copier of the present invention operates in the following manner. During a first revolution of the photoconductive member, the developing unit applies a first colored toner to the photoconductive belt forming a developed image of a particular color. The developed image is then transferred to the transfer belt. The photoconductive member continues to rotate and a second colored image is developed on the photoconductive member. The second developed color image is then transferred to the transfer belt. This continues until all of the developed colored images are transferred to the transfer belt, whereupon the sheet of paper is brought into contact with the transfer belt and the fully developed color image is transferred to the paper.

In a preferred embodiment, the photoconductive member comprises a vertically mounted photoconductive belt which cooperates with a horizontally mounted transfer belt. The sheet of paper travels along a substantially planar paper path located near the top of the apparatus. As it travels along the paper path, the sheet of paper is imprinted as the transfer belt makes contact with the sheet of paper.

DETAILED DESCRIPTION OF THE PREFERRED EMBODIMENT

Figure 1:
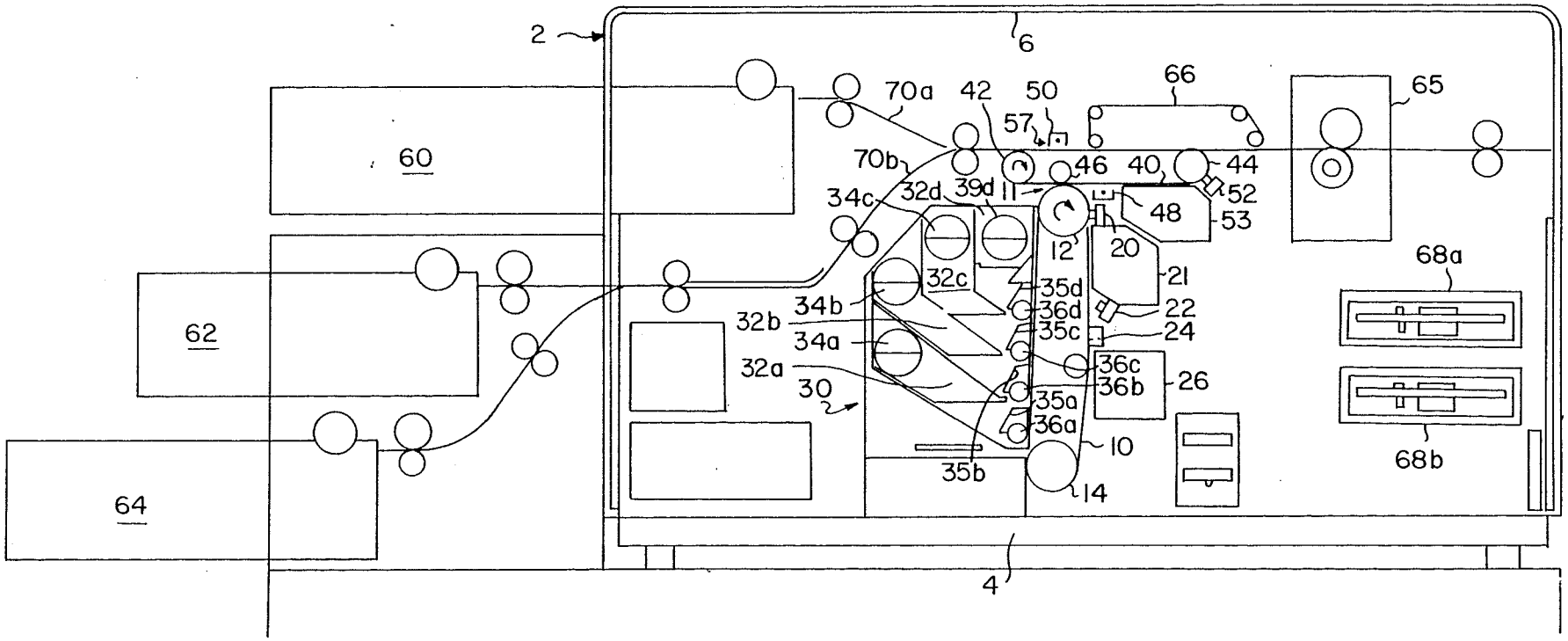
FIG. 1 is diagram of an electrographic color printer/-copier in accordance with an illustrative embodiment of the present invention.

FIG. 1 is a block diagram showing the basic components of an electrographic color printer 2 in accordance with one aspect of the present invention. The color printer 2 includes a housing 4 and a lid 6 at the top. The lid may be opened by being pivoted upwardly to provide access to the interior of the machine. Such printers typically include a photoconductive member which, in this illustrative embodiment, is a photoconductive belt 10. Desirably, the photoconductive member comprises a photoconductive belt assembly such as the disposable cassette which is disclosed and claimed in the previously mentioned allowed application Ser. No. 718,947, filed Apr. 2, 1985, now U.S. Pat. No. 4,657,369. As illustrated in FIG. 1, this photoconductive belt assembly is mounted vertically in the electrographic color printer of the present invention and has a transfer zone 11 associated with it.

As illustrated, the photoconductive belt 10 rotates clockwise by means of rollers 12 and 14. Located along the right side of photoconductive belt 10, as viewed in FIG. 1, are a cleaning unit 20 with a receptacle 21 attached thereto, erase lamp 22, the main charging unit 24, and an optical print head 26.

On the left side of photoconductive belt 10, as viewed in FIG. 1, is a developer unit generally shown by the number 30. Developer unit 30 resembles in certain respects the developer unit disclosed and claimed in allowed application Ser. No. 718,946, now U.S. Pat. No. 4,639,116. However, developer unit 30 includes four containers **32*a*, 32*b*, 32*c*, and 32*d*. Each of the containers of developer unit 30 is designed to hold and apply a different colored toner to photoconductive belt 10 in order to develop a fully colored latent image. Thus, each of containers 32*a*, 32*b*, 32*c*, and 32*d* includes a replaceable toner cartridge 34*a*, 34*b*, 34*c*, and 34*d* which cartridges contain black toner and toners forming a set of primary colors, e.g., the set of red, yellow, and blue, or the set of cyan, yellow, and magenta. The differently colored toners are released from cartridges 34*a*, 34*b*, 34*c*, and 34*d*, and collect at the bottom of their respective containers forming reservoirs 35*a*, 35*b*, 35*c*, and 35*d*. Containers 32*a*, 32*b*, 32*c*, and 32*d* also include delivery rollers 36*a*, 36*b*, 36*c*, and 36*d* respectively by means of which the differently colored toners are successively applied to photoconductive belt 10 as it rotates by developer unit 30** on successive revolutions.

In addition, developer unit 30 differs from the developer unit of the previously mentioned application in that it does not operate alternately between a developing mode and a cleaning mode. In the present apparatus, a separate cleaning unit 20 is provided to clean photoconductive belt 10 continuously as it rotates. Developer unit 30 acts strictly to develop the electrostatic latent image on photoconductive belt 10 and not to clean residual toner particles from photoconductive belt 10.

Figure 2:
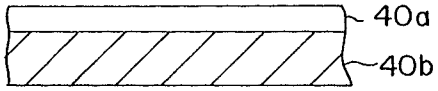
FIG. 2 an enlarged view of the transfer belt which comprises a component of the electrographic color printer/ copier of the present invention.
Figure 3:
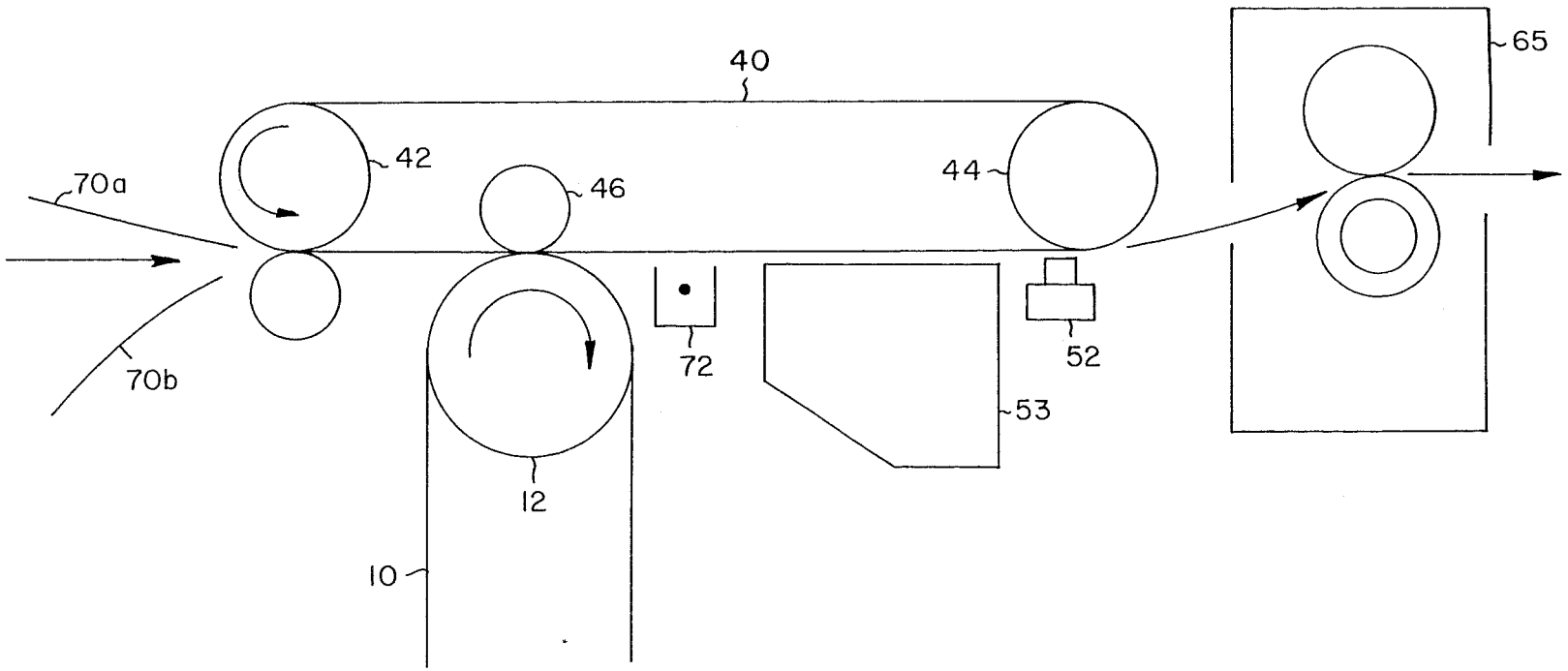
FIG. 3 schematic diagram of another illustrative embodiment of the electrographic color/printer of the present invention.

Located above photoconductive belt 10 and mounted horizontally in housing 2 is transfer belt 40. As illustrated in FIG. 2, transfer belt 40 comprises two separate layers. Layer 40*a* is made from a dielectric insulating material, such as rubber. Layer 40*b* is made from a flexible conductive material; for example, a commercially available conductive rubber. Layer 40*a* forms the outside of transfer belt 10 as viewed in FIG. 1.

Transfer belt 40 is designed to receive the developed latent image from photoconductive belt 10 and to transfer it to a sheet of recording medium at the appropriate time. To accomplish this, transfer belt 40 rotates in a clockwise direction as illustrated about rollers 42 and 44. A third roller 46 maintains transfer belt 40 in contact with photoconductive belt 10. A charging unit 48 is associated with transfer belt 40. The purpose of charging unit 48 is to charge transfer belt to a high enough voltage so that the developed image will be transferred from photoconductive belt 10 to transfer belt 40 as it passes through transfer zone 11.

A transfer corona 50 is also associated with transfer belt 40. The purpose of transfer corona 50 is to transfer the fully developed color image from transfer belt 40 to the sheet of paper as it passes through a second transfer zone 51. A cleaning unit 52 having a receptacle 53 is also provided for transfer belt 40. Cleaning unit 52, which may comprise a brush roller or a scraper blade, cleans transfer belt 40 and readies it for use again after the paper has been imprinted with the color image.

Various other components of electrographic color printer 2 are also illustrated in FIG. 1. Thus, paper may be received from any one of cassettes 60, 62, and 64, and is transported by means of a number of paper transport rollers. After the paper has been imprinted, it is transported from transfer zone 51 to fuser unit 65 by means of vacuum transport 66. Vacuum transport 66 makes contact with the upper, unprinted side of the paper to avoid smudging. From the fuser unit 65 the paper is ejected into an output tray (not shown) face down where it is automatically collated.

The operation of the electrographic color printer 2 of the present invention will now be described by reference to the embodiment illustrated in FIG. 1. Initially, as photoconductive belt 10 begins its first revolution, the main charging unit 24 charges up the photosensitive surface of photoconductive belt 10 to a uniform charging potential of, e.g., about −550V. Optical print head 26, which in the illustrative embodiment comprises an LED array, discharges selected portions of the photosensitive surface which correspond to informational areas which require one of the toner colors, e.g., to informational areas which contain black color. Thus, an electrostatic latent image corresponding to the black informational areas to be printed is formed on photoconductive belt 10. This electrostatic latent image carries a voltage potential of, e.g., about −100V and is surrounded by −550V background regions. As photoconductive belt 10 continues to rotate, delivery roller 36*a* of developer unit 30 is switched on and black toner carrying a negative charge of, e.g., about −100V is applied to photoconductive belt 10. The −100V toner particles are attracted to the "relatively positive" −100V latent image on photoconductive belt 10 while being repelled from the −550V background regions. The "black" electrostatic latent image on photoconductive belt 10 is thus developed by the black toner to form a black developed powder image on photoconductive belt 10.

Simultaneously with the revolution of photoconductive belt 10, transfer belt 40 is charged to a biasing voltage of, e.g., about +1000V to +2000V, and is caused to rotate in a clockwise direction about rollers 42 and 44 as shown. Because transfer belt 40 is charged to a higher and "more positive" voltage than the informational areas on photoconductive belt 10, as the two belts rotate, the black toner particles at −100V are attracted to transfer belt 40. Thus, the black developed powder image is transferred from photoconductive belt 10 to transfer belt 40. As photoconductive belt 10 continues to rotate, it is cleaned by means of cleaning unit 20 and then discharged by erase lamp 22, at which point it is ready to start its second revolution. In the meantime, the black developed image is retained on transfer belt 40.

During the second revolution of photoconductive belt 10, it is recharged again to a suitable charging potential by means of main charging unit 24 and passes before optical print head 26 a second time. This time, optical print head 26 discharges selected areas of photoconductive belt 10 corresponding to informational areas which require a different colored toner, e.g., to informational areas which require red. Thus, a "red" electrostatic latent image is formed on photoconductive belt 10.

Delivery roller 36*b* is switched off while delivery roller 36*b* is switched on and red toner is applied to the photoconductive belt 10. The electrostatic latent image now on photoconductive belt 10 is thereby developed in red. Thereafter, the red powder image is transferred to transfer belt 40 in a manner similar to that described above. This operation continues through two more successive revolutions of photoconductive belt 10 as yellow and blue powder images are developed on photoconductive belt 10 and then transferred to transfer belt 40. Thus, a fully developed color image is formed on transfer belt 40. Of course, as is well known to those skilled in the art, it is possible to form the fully developed color image with a different set of primary colors, e.g., cyan, yellow, and magenta.

Once all of the powder images have been transferred to transfer belt 40, a sheet of paper 70*a* or 70*b*, or some other recording medium, which is derived from any of the illustrated input paper cassettes is brought into contact from above with transfer belt 40. Transfer unit 50, located above transfer belt 40, creates an electric field to attract all of the colored toner particles from transfer belt 40 onto the underside of the sheet of paper as it passes through transfer region 51. The paper is then transported by means of vacuum transport unit 66 through the fusing station 65 where the toner particles are fused into the paper. From there, the paper is ejected into an output tray (not shown), printed side down, thus being automatically collated. In the meantime, transfer belt 40 is cleaned by means of cleaning unit 52 and recharged by charging unit 48 in order to be ready to make the next copy.

The electrographic printer illustrated in FIG. 1 is a so-called "smart printer". That is, this electrographic printer contains an on-board controller which controls and coordinates each of the operations of its various components. The controller receives a variety of signals from various sensors and command stations associated with the printer and sends out a variety of signals in response thereto which coordinate the operation of the various components of the printer. Thus, the controller receives signals from various sensors to detect malfunctions in the printer and sends out signals to alert the operator to these malfunctions. The controller also interfaces with a computer terminal, as well as with diskette drives 68a and 68b, to control operation of optical print head 26. The diskette drives serve as a buffer to store text and/or graphics downloaded from the computer terminal. The diskette drives 68a and 68b also store a variety of pre-packaged downloadable fonts and graphics packages.

The on-board controller is also effective to coordinate operation of optical print head 26 with developer unit 30. In particular, the on-board controller is effective to switch on the appropriate delivery roller, e.g., the black toner delivery roller, when the optical print head produces an electrostatic latent image on the photoconductive belt which requires that particular color, e.g., the "black developed image". It is also effective to mix two or more primary colors in the correct proportions to form a third color when that is required.

Thus, for example, to form a color which comprises two-thirds yellow toner and one-third red toner, the controller will cause the optical print head 26 (e.g., the LED array) to shine with twice the intensity when photoconductive belt 10 makes the pass corresponding to the yellow latent image, as when it makes the pass corresponding to the red latent image.

Additionally, the on-board controller is effective to control operation of the paper transport system so that the paper is held in reserve until the four revolutions of the photoconductive belt and transfer belt are completed and the fully developed colored image is ready to be transferred to the sheet of paper.

It will be observed that the electrographic color printer/copier of the present invention retains the simplified paper path of the printer/copier disclosed in application Ser. No. 700,813. Thus, the present color printer has a substantially planar paper path near the top of housing 4 of the machine. This paper path may be easily accessed from the top in case of a paper jam by lifting lid 6. Further, the paper is imprinted from below and is ejected into a paper tray with the printed side down so that it is automatically collated.

It will further be observed that cleaning unit 20 functions continuously to clean photoconductive belt 10 during each of its revolutions so that it can be readied for the next revolution in which a different colored toner is applied. In contrast, cleaning unit 52 operates to clean transfer belt 40 only once every four revolutions, i.e., after the fully developed color image is transferred to the sheet of paper. This is because transfer belt 40 must retain the partially developed image thereon until it becomes fully developed. Again, the on-board controller is effective to actuate cleaning unit 52 at the proper time.

Referring now to FIG. 2, wherein like numerals refer to like elements, a second embodiment of the color printer of the present invention is disclosed. This second embodiment of color printer is similar to the embodiment illustrated in FIG. 1 but with some important differences. In particular, in the embodiment illustrated in FIG. 2 the sheet of paper is caused to pass between photoconductive belt 10 and transfer belt 40. Thus, in this embodiment, the fully developed color image on transfer belt 40 is transferred to the upper side of the paper. Furthermore, in this embodiment, a corona unit 72 acts as both a charging unit to charge the transfer belt 40 to a sufficiently high voltage in order to attract each of the developed color images to transfer belt, and, at the appropriate time, as a transfer unit to transfer the fully developed color image from transfer belt 40 to the upper side of the sheet of paper.

Operation of the embodiment illustrated in FIG. 2 is similar to the previously described operation of the embodiment illustrated in FIG. 1. In particular, photoconductive belt 10 is charged to a suitable voltage and is caused to make four revolutions. During each of these revolutions a different colored image is developed on photoconductive belt 10. Simultaneously, transfer belt 40 rotates together with photoconductive belt 10. Each of the differently colored developed images is sequentially transferred to transfer belt, which has been charged to about +1000V to about +2000V by means of corona unit 72.

Once this is completed, transfer belt 40 and photoconductive belt 10 make a fifth revolution. During this revolution, the sheet of paper is caused to pass between transfer belt 40 and photoconductive belt 10. Corona unit 72 is switched to a higher voltage of about +3000V. When the sheet of paper enters the transfer region between transfer belt 40 and corona unit 72, the fully developed color image is transferred to the upper side of the sheet of paper. Thereafter, the sheet of paper enters fusing unit 65 and is then ejected into a paper tray (not shown).

It will be observed that in this embodiment, rollers 42 and 44 rotate in a counter-clockwise direction in contrast to the embodiment illustrated in FIG. 1. It will further be observed that in this embodiment, no vacuum transport unit is needed as the sheet of paper is carried along to fuser unit 65 by means of transfer belt 40. Furthermore, in this embodiment the paper is not automatically collated when it is ejected into the paper tray as the color image is imprinted onto the top side of the sheet of paper. Nevertheless, in this embodiment, as in the embodiment of FIG. 1, the sheet of paper travels along a substantially planar paper path in the near to the top of the machine.

Although the present invention has been described in terms of a smart printer, by inclusion of suitable optics, the present invention can be adapted to encompass a smart copier. Thus, with suitable optics, the controller can be instructed to switch the delivery rollers on and off in coordination with the photoconductive belt so that a colored powder image is first transferred to the transfer belt and then to the sheet of paper.

While the invention has been described by reference to specific embodiments, this was for purposes of illustration only and should not be construed to limit the spirit or the scope of the invention.

We claim:

1. An electrographic printing apparatus for imprinting information on a sheet of paper or the like, comprising a housing, a source of paper and an output for said paper after it is imprinted, a paper path along which said paper travels within said printing apparatus, a photoconductive member for storing a latent electrostatic image of information to be imprinted, developer means for developing said latent electrostatic image on said photoconductive member, a transfer belt cooperating with said photoconductive member for receiving said developed image from said photoconductive member and for transferring said developed image to said paper, said transfer belt comprising a first layer made from a dielectric insulating material, and a second layer made from a flexible conductive material.

2. The electrographic printing apparatus of claim 1 wherein said developer means contains toners of more than one color, said developer means being operative to produce a multicolored developed image.

3. The electrographic printing apparatus of claim 1 wherein said developer means includes multiple compartments, each of said compartments containing a different colored toner, and means for applying said different color toners to said electrostatic latent image upon successive revolutions of said photoconductive member.

4. The electrostatic printing apparatus of claim 1 wherein said photoconductive member comprises a photoconductive belt.

5. The electrographic printing apparatus of claim 1 wherein said photoconductive member comprises a vertically mounted photoconductive belt.

6. The electrographic printing apparatus of claim 1 wherein said transfer belt is horizontally mounted.

7. The electrographic printing apparatus of claim 1 wherein said photoconductive member comprises a vertically mounted photoconductive belt and said transfer belt is horizontally mounted above said photoconductive belt.

8. The electrographic printing apparatus of claim 1 wherein said transfer belt includes a dielectric insulating layer.

9. The electrographic printing apparatus of claim 1 wherein said transfer belt is made from rubber.

10. The electrographic printing apparatus of claim 1 wherein said first layer is made from dielectrically insulating rubber, and said second layer is made from conductive rubber.

11. The electrographic printing apparatus of claim 1 wherein said transfer belt comes into contact with said paper from below in a transfer zone located in said paper path to transfer said developed image to the underside of said paper.

12. The electrographic printing apparatus of claim 1 wherein said transfer belt comes into contact with said paper from above in a transfer zone located in said paper path to transfer said developed image to the topside of said paper.

13. The electrographic printing apparatus of claim 1 further comprising an openable lid located near the top of the electrographic printing apparatus, said paper path being accessible from outside said housing upon opening said lid.

14. The electrographic printing apparatus of claim 1 further comprising a discharging unit for selectively discharging portions of said photoconductive member to form said electrostatic latent image thereon.

15. The electrographic printing apparatus of claim 1 further comprising an optical print head for selectively discharging portions of said photoconductive member to form said electrostatic latent image thereon.

16. The electrographic printing apparatus of claim 1 further comprising means for removing residual toner particles from said photoconductive member.

17. The electrographic printing apparatus of claim 1 further comprising means for removing residual toner particles from said transfer belt.

18. An electrographic color printing apparatus for imprinting information in color on a sheet of paper or the like, comprising a housing, a source of paper and an output for said paper after it is imprinted, a paper path along which said paper travels within said printing apparatus, a photoconductive member for storing a latent electrostatic image of information to be imprinted, developer means containing toners of multiple colors for developing said electrostatic image in multiple colors, a transfer belt cooperating with said photoconductive member for receiving said developed color image from said photoconductive member and for transferring said developed color image to said paper, wherein said photoconductive member comprises a vertically aligned photoconductive belt, and said transfer belt is located above said photoconductive belt.

19. The electrographic color printing apparatus of claim 18 wherein said transfer belt is aligned horizontally.

20. The electrographic color printing apparatus of claim 18 wherein said transfer belt includes a dielectric insulating material.

21. The electrographic color printing apparatus of claim 20 wherein said transfer belt comes into contact with said paper from below in a transfer zone located in said paper path to transfer said developed color image to the underside of said paper.

22. The electrographic color printing apparatus of claim 20 wherein said transfer belt comes into contact with said paper from above in a transfer zone located in said paper path to transfer said developed color image to the topside of said paper.

23. The electrographic color printing apparatus of claim 20 further comprising an openable lid located near the top of the electrographic color printing apparatus, said paper path being accessible from outside said housing upon opening said lid.

24. The electrographic color printing apparatus of claim 23 further comprising a discharging unit for selectively discharging portions of said photoconductive member to form said electrostatic latent image thereon.

25. The electrographic color printing apparatus of claim 24 wherein said discharging unit comprises an optical print head.

26. The electrographic color printing apparatus of claim 25 further comprising means for removing residual toner particles from said photoconductive member.

27. The electrographic color printing apparatus of claim 26 further comprising means for removing residual toner particles from said transfer belt.

28. An electrographic printing apparatus for imprinting information in color on a sheet of paper or the like, comprising a rotatable photoconductive member, means for charging said photoconductve member, means for discharging selected portions of said photoconductive member to form an electrostatic latent image thereon, means for developing said latent image in different colors upon successive revolutions of said photoconductive belt, and means for receiving and retaining each of said developed color images, and for transferring them to said paper, wherein said receiving and retaining means comprises a transfer belt having a first layer made from a dielectric insulating material and a second layer made from a flexible conductive material.

29. The electrographic printing apparatus of claim 28 wherein said photoconductive member is discharged to a first voltage, and said receiving, retaining, and transferring means is charged to a second voltage, said second voltage being effective to attract said developed color images from said photoconductive member to said trasfer belt.

30. An electrographic printing apparatus for imprinting information on a sheet of paper or the like, comprising a housing, a source of paper and an output for said paper after it is imprinted, a paper path along which said paper travels within said printing apparatus, a photoconductive member for storing a latent electrostatic image of information to be imprinted, developer means for developing said latent electrostatic image on said photoconductive member, and a transfer belt cooperating with said photoconductive member for receiving said developed image from said photoconductive member and for transferring said developed image to said paper, wherein said photoconductive member comprises a vertically mounted photoconductive belt, and wherein said transfer belt is horizontally mounted above said photoconductive member.

31. The electrographic printing apparatus of claim 30 wherein said transfer belt comes into contact with said paper from below in a transfer zone located in said paper path to transfer said developed image to the underside of said paper.

32. An electrographic printing apparatus for imprinting information on a sheet of paper or the like, comprising a housing, a source of paper and an output for said paper after it is imprinted, a paper path along which said paper travels within said printing apparatus, a photoconductive member for storing a latent electrostatic image of information to be imprinted, developer means for developing said latent electrostatic image on said photoconductive member, and a transfer belt cooperating with said photoconductive member for receiving said developed image from said photoconductive member and for transferring said developed image to said paper, wherein said transfer belt comes into contact with said paper from above in a transfer zone located in said paper path to transfer said developed image to the top side of said paper.

* * * * *